US008807246B2

(12) United States Patent
Lassoie et al.

(10) Patent No.: US 8,807,246 B2
(45) Date of Patent: Aug. 19, 2014

(54) DOWNHOLE TOOL AND CONTROL MODULE

(71) Applicant: Halliburton Energy Services, Inc., Houston, TX (US)

(72) Inventors: Jean-Pierre Lassoie, Brussels (BE); John Ransford Hardin, Jr., Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/112,229

(22) PCT Filed: Oct. 22, 2012

(86) PCT No.: PCT/IB2012/055804

§ 371 (c)(1), (2), (4) Date: Oct. 16, 2013

(87) PCT Pub. No.: WO2014/064485

PCT Pub. Date: May 1, 2014

(65) Prior Publication Data

US 2014/0110171 A1 Apr. 24, 2014

(51) Int. Cl.
*E21B 10/32* (2006.01)
*E21B 44/00* (2006.01)

(52) U.S. Cl.
CPC ..... *E21B 44/00* (2013.01); *E21B 10/322* (2013.01); *E21B 10/32* (2013.01)
USPC ..... 175/263; 175/269; 175/285

(58) Field of Classification Search
CPC ..... E21B 10/32; E21B 10/322; E21B 10/327
USPC ..... 175/263, 384, 266, 269, 320, 230, 292, 175/284, 285
See application file for complete search history.

(56) References Cited

U.S. PATENT DOCUMENTS 1,484,065 A * 2/1924 Gould ..... 175/94
1,885,550 A 11/1932 Santiago (Continued)

FOREIGN PATENT DOCUMENTS

EP 0162981 12/1985
WO WO94/21889 9/1994

OTHER PUBLICATIONS

International Search Report and Written Opinion issues Aug. 19, 2013 by Authorized Officer Ingo Meyer of European Patent Office, 59 pages.

*Primary Examiner* — Kenneth L Thompson
(74) *Attorney, Agent, or Firm* — Alan Bryson; Fish & Richardson P.C.

(57) ABSTRACT

Described herein is a reamer tool (100) having a body (105) with bays (115) in which cutter arms (110) are mounted for deployment between a stowed position and a deployed position. A deployment mechanism is provided for deploying the cutter arms from their stowed position to their deployed position that maintains each cutter arm in a position that is substantially parallel to a longitudinal axis of the body (105) whilst in its stowed position and in its deployed position as well as during its deployment from its stowed position to its deployed position. A control module (300) is also described for controlling the deployment of the cutter arms (110). The control module (300) comprises a motor (310), a gearing mechanism (315) and a moveable element (320) that closes a port (385) in a first position and opens the port (385) in a second position. Fluid flow enters a chamber (340) behind a piston (170) through the port (385) to allow pressure to build up before actuating the piston (170) and thereby the deployment mechanism for the cutter arms (170).

13 Claims, 3 Drawing Sheets

(56) References Cited

U.S. PATENT DOCUMENTS

| | | | | | |
|---|---|---|---|---|---|
| 2,013,457 | A | * | 9/1935 | Burt | 175/77 |
| 3,336,989 | A | * | 8/1967 | Henderson | 175/18 |
| 3,423,671 | A | * | 1/1969 | Vezin | 324/347 |
| 4,711,037 | A | * | 12/1987 | Saadat | 33/520 |
| 4,854,403 | A | | 8/1989 | Ostertag | |
| 6,702,010 | B2 | * | 3/2004 | Yuratich et al. | 166/66 |
| 7,401,666 | B2 | * | 7/2008 | Fanuel et al. | 175/285 |
| 8,028,766 | B2 | * | 10/2011 | Moore | 175/98 |
| 8,468,882 | B2 | * | 6/2013 | Anish et al. | 73/152.02 |
| 8,540,035 | B2 | * | 9/2013 | Xu et al. | 175/268 |
| 2006/0096786 | A1 | | 5/2006 | Wells | |

* cited by examiner

DOWNHOLE TOOL AND CONTROL MODULE

FIELD OF THE INVENTION

The present invention relates to improvements in or relating to downhole tools, and is more particularly, although not exclusively, concerned with reamer tools.

BACKGROUND TO THE INVENTION

Earth formation drilling utilises a long string of drilling pipes and tools coupled together. All elements of the drilling string are rotated together in order to rotate a cutting bit at the end of the drilling sting. The cutting bit creates a hole in a formation through which the rest of the drilling string moves in a drilling direction. An under-reamer, coupled between two other elements of the drilling string, is used to widen the walls of the hole created by the drill bit. The under-reamer, also known as a reamer, normally has an overall diameter in its retracted position which is the same as or less than the diameter of the hole being drilled. When in its deployed position, cutting elements are moved away from the body of the under-reamer to define a diameter which is larger than the diameter of the hole being drilled. As the under-reamer moves downhole rotating with the drilling string, it widens the hole in the formation behind the drill bit. In addition, an under-reamer may be used to open a collapsed formation on its way back up to the surface.

WO-A-2005/124094 describes one such under-reamer or reamer tool. The reamer tool comprises a tubular body having an axial cavity and housings arranged around its periphery to define external openings. In each of these openings, a cutter element is housed which comprises two cutter arms that can be moved between a retracted position where each cutter element is fully retained within its associated housing, and an expanded position where each cutting element extends outside its opening so that more material can be cut away the walls of the hole in a formation thereby enlarging its diameter. A drive mechanism is provided within the tubular body to move the cutter elements between their retracted and expanded positions.

In the reamer tool described in WO-A-2005/124094, one cutter arm is pivotally connected to the tubular body at one end and to the other cutter arm at the other end, the other cutter arm being connected to the drive mechanism so that both cutter arms can be retracted and expanded. The arrangement formed by the two cutter arms when deployed is a 'V'-shape where the vertex of the V is outside the opening.

Typically, such reamer tools are operated by the pressure of fluid passing through the drill string, and in particular, through the tool section itself. The pressure of fluid is controlled by the operation of a pump associated with the drill string. In US-A-2010/0006339, the pressure of fluid passing through the tool is used to operate the reamer so that it is expanded or retracted in accordance therewith. Here, the reamer assembly comprises cutter elements and stabiliser pads mounted for sliding movement on grooves. In the retracted position, the reamer assembly is housed within a recess, the reamer assembly being moved to the expanded position by movement along the grooves so that it is outside the recess. Fluid pressure is sensed to activate the expansion and retraction of the reamer.

US-A-2010/0096191 discloses an under-reaming and stabilisation tool in which a blade element is moved from a retracted position to an expanded position by wedge elements coupled to a drive tube, the wedge elements interact with an inclined face of the blade element to effect the raising (expansion) and lowering (retraction) of the blade element relative to a guide channel. As the drive tube moves along the length of the tool body, the wedge elements are drawn along therewith and they slide under the inclined face of the blade element causing radial movement of the blade element to raise out (expand) out of its guide channel. Movement of the drive tube in the opposite direction along the length of the tool body withdraws the wedge elements from under the inclined face of the blade element allowing radial movement of the blade element to lower (retract) into its guide channel. The expansion of the blade element is limited by the actuation mechanism, that is, the drive tube and wedge elements coupled thereto.

SUMMARY OF THE INVENTION

It is therefore an object of the present invention to provide an improved reamer tool in which the cutter arms or blades are maintained parallel to the axis of the reamer tool in both its retracted and deployed positions as well as during expansion and retraction whilst providing a higher opening range.

It is a further object of the present invention to provide a reamer tool in which the opening can be adjusted at the surface in accordance with a value within the opening range whilst providing a more efficient reamer tool.

In accordance with a first aspect of the present invention, there is provided a reamer tool comprising:

a substantially hollow body having a longitudinal axis and including an external wall having a first outer diameter;

at least one arm bay formed in a portion of the external wall around the periphery of the body;

at least one expandable arm located in an associated arm bay and mounted for expansion between a retracted position within the body and an expanded position in which each expandable arm describes a second outer diameter which is greater than the first outer diameter; and at least one expansion mechanism for expanding an associated expandable arm between the retracted and expanded positions;

characterised in that each expansion mechanism comprises two elongate links pivotally connected to the associated expandable arm at one end position and to its associated arm bay at another end position, each expandable arm being pivotally mounted at the two end positions with respect to its associated arm bay so that each expandable arm is maintained substantially parallel to the longitudinal axis of the body in both the retracted and expanded positions and during its expansion and retraction between the retracted and expanded positions.

By having links connecting each expandable arm to its associated arm bay, the expandable arm can be maintained substantially parallel to the longitudinal axis of the reamer tool thereby providing an opening range which is greater than that possible with expansion mechanisms comprising wedge elements or the like.

In the case where the downhole tool comprises a reamer tool, the advantage of maintaining the expandable arm parallel to the longitudinal axis of the body is that the attack point for each cutting blade is reliable, the attack point being the point at which a leading cutting element engages with the material or formation to be cut.

Naturally, an actuation mechanism is also provided for activating the expansion mechanism, each expandable arm being pivotally connected at another end position to the actuation mechanism.

Advantageously, the expansion mechanism further comprises a third elongate link pivotally connected to each expandable arm and to the actuation mechanism.

In this way, the actuation mechanism directly moves the expandable arm and the other elongate links serve to maintain the substantial parallelism with the longitudinal axis. In a preferred embodiment, the actuation mechanism comprises a piston.

The downhole tool may further comprise at least one return member for deactivating each deployment mechanism. In one embodiment, each return member comprises a spring biased against the action of the actuation mechanism.

A shoulder block may be provided which is locatable in each arm bay to limit the expansion of the expandable arm. By selecting a suitably sized shoulder block, the expansion of the expandable arm can be determined to provide a desired outer diameter for engagement with a formation.

In a preferred embodiment, the second outer diameter may be up to 1.3 times the first outer diameter. For example, if the outer diameter of the downhole tool is 100 cm, the expandable arms may be expanded to describe an outer diameter of up to 130 cm.

Preferably, the downhole tool comprises a reamer tool and each expandable arm comprises a cutter arm.

In accordance with another aspect of the present invention, there is provided an expandable cutter arm for a downhole tool, the expandable cutter arm comprising at least a front cutting blade and a back cutting blade, each cutting blade comprising a plurality of cutting elements, one cutting element on each of the front cutting blade and the back cutting blade providing an attack point for the associated cutting blade.

Such an expandable cutter arm may further comprise a first side and a second side located either side of a plane, each side being spaced at respective predetermined distances from a plane so that the attack point for the front blade and the attack point for the back blade are equi-spaced from the plane.

By having the attack point for each cutter arm equi-spaced from the plane, efficiency of the reamer tool is improved. In addition, a more flexible reamer tool is provided in which a range of opening sizes can be accommodated.

The predetermined distance for the first side may be different to the predetermined distance for the second side.

In one embodiment, the cutting elements may comprise polycrystalline diamond cutting elements.

In accordance with a further aspect of the present invention, there is provided a reamer tool having at least one expandable cutter arm as described above.

In accordance with another aspect of the present invention, there is provided a reamer tool having a longitudinal axis, the reamer tool comprising at least one expandable cutter arm having a plurality of cutting elements arranged to form at least a front cutting blade and a back cutting blade, one of the cutting elements on the front cutting blade and one of the cutting elements on the back cutting blade providing respective attack points for their associated cutting blades, characterised in that the attack point for the front cutting blade and the attack point for the back cutting blade are equi-spaced from a plane extending through the longitudinal axis.

The reamer tool preferably further comprises at least one expansion mechanism for expanding an associated expandable cutter arm between a retracted position and an expanded position, and an actuation mechanism for activating each expansion mechanism.

In a preferred embodiment, each expansion mechanism comprises at least two elongate links pivotally connected to the associated expandable cutter arm at one end position and to its associated arm bay at another end position, each expandable cutter arm being pivotally mounted at the two end positions with respect to its associated arm bas so that each expandable cutter arm is maintained substantially parallel to the longitudinal axis in both the retracted and expanded positions, and, during expansion and retraction between the retracted and expanded positions.

The expansion mechanism advantageously further comprises a third elongate link pivotally connected to each expandable cutter arm and to the actuation mechanism, each expandable cutter arm being pivotally connected at another end position to the actuation mechanism.

The actuation mechanism preferably comprises a piston. The reamer tool may further comprise at least one return member for deactivating each expansion mechanism.

A shoulder block may be provided which is locatable in each arm bay to limit the expansion of the expandable cutter arm. The cutter arm may have an opening range up to 1.3 times the outer diameter of the reamer tool, the shoulder block limiting the opening in accordance with it size.

In accordance with another aspect of the present invention, there is provided a control module for a downhole tool, the downhole tool including a substantially hollow body having a longitudinal axis, at least one arm bay formed around the periphery of the substantially hollow body, at least one expandable arm located in an associated arm bay and mounted for expansion between a retracted position within the substantially hollow body and an expanded position in which the expandable arm describes a second outer diameter which is greater than the first outer diameter, at least one expansion mechanism for expanding an associated expandable arm between the retracted and expanded positions, and a piston for operating each expandable arm, the control module comprising:

an element mounted within the body which is moveable between a first position and second position;

a motor controlling the movement of the element; and a gearing mechanism associated with the motor for transferring drive from the motor to the element;

characterised in that the control module further comprises a chamber and a port, the chamber being associated with the piston and the port having an open position and a closed position, the open and closed position being determined by the second and first positions respectively of the element;

and in that the port, in its open position, allows fluid to flow into the chamber and to increase the pressure therein for operation of the piston to expand each expandable arm.

In a preferred embodiment, the motor and gearing mechanism are mounted between the element and the external wall of the body. A power source is preferably located within the body of the reamer tool. This has the advantage of protecting the control module, that is, the motor, gearing mechanism and power source from the environment in which the reamer tool operates.

In one embodiment, the power source comprises a battery. In another embodiment, the power source comprises a turbine arranged to generate power for the motor.

The control module may further comprise at least one positional sensor for sensing the position of the element within the body. In addition, at least one pressure sensor may also be provided for sensing the pressure within the chamber.

In addition, at least one sensor may be provided for sensing at least a change in pressure in fluid flowing through the downhole tool, each sensor providing a control signal for the motor. Moreover, at least one sensor may be provided for sensing a change in rotational speed of the downhole tool, each sensor providing a control signal for the motor.

Additionally, a communications system may be provided through which control signals are provided for the motor. In one embodiment, the communications system includes a wired link over which control signals are transmitted.

BRIEF DESCRIPTION OF THE DRAWINGS

For a better understanding of the present invention, reference will now be made, by way of example only, to the accompanying drawings in which.

DESCRIPTION OF THE INVENTION

Figure 1:
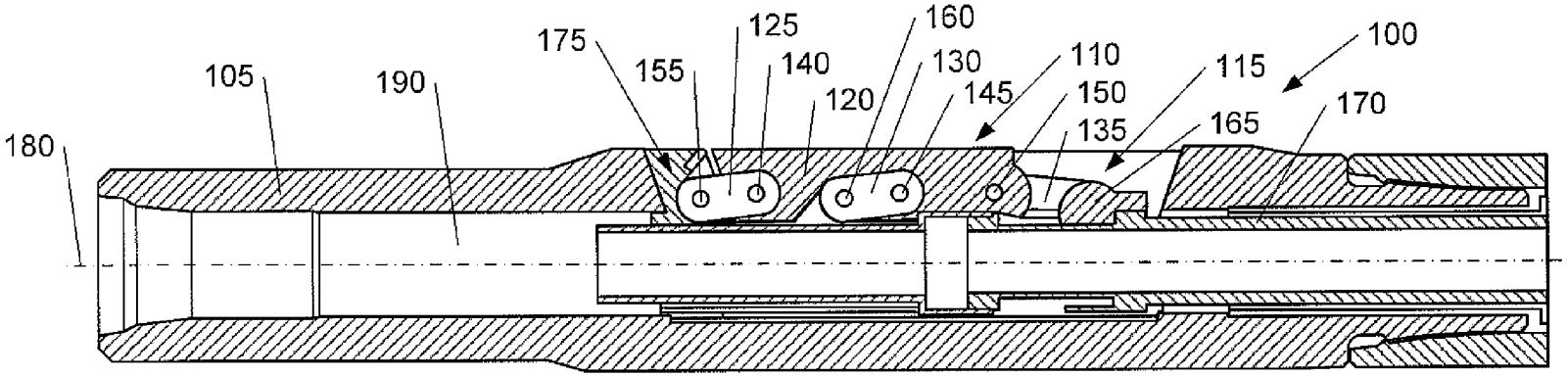
FIG. 1 illustrates a schematic sectioned view of a reamer tool in accordance with the present invention, the reamer tool being shown in a retracted position.

The present invention will be described with respect to particular embodiments and with reference to certain drawings but the invention is not limited thereto. The drawings described are only schematic and are non-limiting. In the drawings, the size of some of the elements may be exaggerated and not drawn on scale for illustrative purposes.

It will be understood that the terms "vertical" and "horizontal" are used herein refer to particular orientations of the Figures and these terms are not limitations to the specific embodiments described herein. In addition, the terms "top" and "bottom" are used to refer to parts of a drill string that face towards the surface, or top of the drill string, and away from the surface, or bottom of the drill string, respectively.

The present invention relates to an improved reamer tool and a control system for operating such a reamer tool or other downhole tool. The reamer tool is described below with reference to FIGS. 1 to 3 and the control system is described with reference to FIGS. 4 and 5.

Although the present invention is described below with respect to a reamer tool having cutter arms, it is equally applicable to a downhole tool that may also be used for stabilisation. In this case, the cutter arms are replaced by stabilising pad arms which, when expanded, contact the walls of a formation to stabilise the drill string of which the tool forms a part. In addition, although the control system is described with reference to use with a reamer tool, it is not limited to use with a reamer tool and can be used with any other downhole tool.

Reamer tools, as well as other downhole tools, are operated, that is, expanded and retracted by changes in the pressure of fluid flowing through the associated drill string. The fluid flow is controlled by a pump associated with the drill string. Changes in fluid pressure are detected by sensors located at appropriate positions in the drill string.

Figure 2:
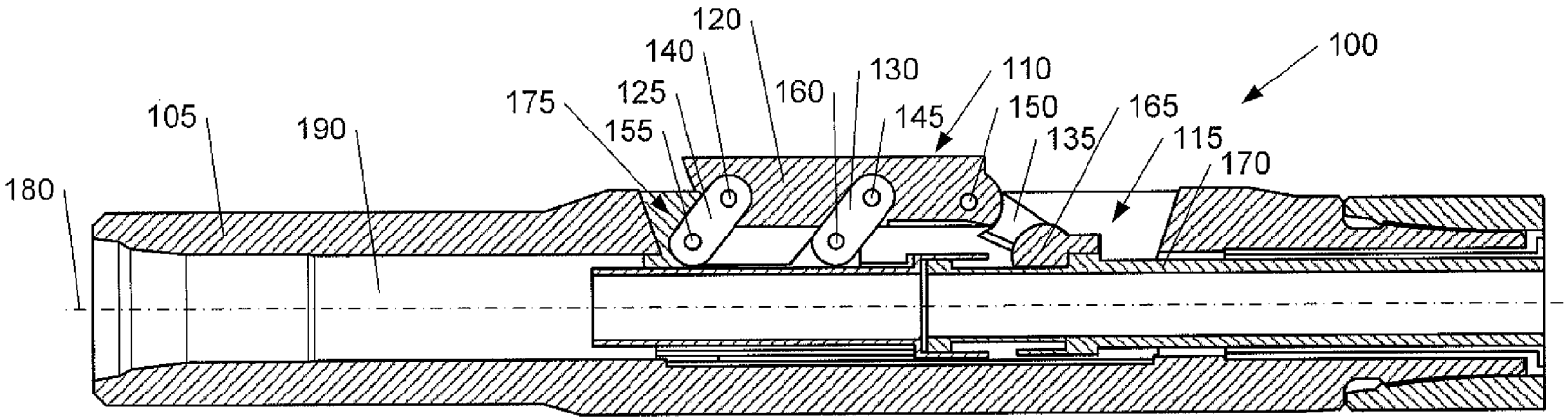
FIG. 2 is similar to FIG. 1 but illustrates the reamer tool in an expanded position.

Referring initially to FIGS. 1 and 2, a longitudinal sectioned view of reamer tool 100 is shown. The reamer tool 100 comprises a reamer body 105 having three cutter arms 110 mounted within respective housings or arm bays 115 formed in the reamer body 105. The three cutter arms 110 are equispaced around the periphery of the reamer body 105 but only one such cutter arm is shown in FIGS. 1 and 2.

Each cutter arm 110 comprises a cutting element or cutting blade 120 which is pivotally mounted on each of three elongate links 125, 130, 135 at respective pivot points 140, 145, 150 as shown. Two of the elongate links 125, 130 are also pivotally attached to the housing or arm bay 115 at respective pivot points 155, 160. The third elongate link 135 is also pivotally mounted, by means of a pivot point 165, on a piston 170.

The piston 170 comprises an actuation mechanism and is operated to move from a first position as shown in FIG. 1 to a second position as shown in FIG. 2 to expand the cutter arms 110, and more particularly, the cutting elements or cutting blades 120, from a retracted position to an expanded position where the cutting elements or cutting blades 120 extend outside the reamer body 105 and define an outer diameter which is up to 1.3 times that of the normal outer diameter of the reamer body 105.

It will be appreciated that, in other embodiments of the reamer tool 100 in accordance with the present invention, the outer diameter defined by the three cutter arms 110 and their cutting elements or cutting blades 120 may have other ratios compared to the outer diameter of the reamer body 105 as required, and, is therefore not limited to up to 1.3 times the outer diameter of the reamer body 105. The outer diameter is limited by a shoulder block 175 and the size of the shoulder block 175 is chosen at the surface before introduction of the drill string of which the reamer tool 100 forms a part into a wellbore in a formation in accordance with the outer diameter of the reamer tool 100 required to from the wellbore in the formation.

It will be appreciated that shoulder blocks of different sizes can be provided with the reamer tool 100 and an appropriately sized shoulder block is chosen to limit the expansion of the cutter arms 110 to control the outer diameter defined by the expanded cutter arms 110 and cutting elements or cutting blades 120 within an opening range from the same outer diameter of the reamer body 105 to 1.3 times that outer diameter.

In the deployment of the cutter arms 110 from inside their respective housings or arm bays 115 formed in the reamer body 105, the cutting structure (not shown) of each cutter arm 110 always remains parallel to a longitudinal axis 180 of the reamer body 105. The pivot points 140, 145, 150, 155, 160, 165 formed on respective ones of the links 125, 130, 135, as described above, effectively provide pivoting axes about which rotation can occur to expand and retract the cutter arms 110 and cutting elements or cutting blades 120 out of and into their respective housings or arm bays 115. However, pivot points 140, 145 provided on respective links 125, 130 ensure that the cutter arms 110 remain parallel to the reamer body 105 as they are expanded, used for cutting and retracted into their respective housings or arm bays 115. Pivot point 150 provided on elongate link 135 is used to expand and retract the associated cutter arm 110 in accordance with the movement of the piston 170 or other actuation mechanism as will be described in more detail below.

By using an expansion mechanism which utilises elongate links pivotally connected to both the cutter arm 110 and the housing or arm bay 115 as well as to the piston 170 or other actuation mechanism, the effective outer diameter of the cutter arm 110 and cutting element or cutting blade 120 can extend up to 1.3 times the outer diameter of the reamer body 105. In addition, the amount of expansion can easily be limited by a suitable shoulder block 175.

The force for expanding the cutter arms 110 is provided by pressure applied to the piston 170, and, the force for retracting the cutter arms is provided by a spring 185 (described below with reference to FIGS. 4 and 5). The applied pressure is provided by fluid flow through the reamer body 105 as will be described in more detail below.

As shown in FIGS. 1 and 2, the reamer body 105 is substantially tubular with a hollow central portion 190 which defines a fluid flow path. The piston 170 is mounted within the reamer body 105 and is operated by fluid flowing therethrough as will described in more detail with reference to FIGS. 4 and 5 below.

In the embodiment of the reamer tool 100 described above, it is essential to ensure that the cutting elements, for example, polycrystalline diamond cutters known as PDC cutters, function adequately during the expansion stages to make contact with the formation in which the reamer tool is to be used. This is described in more detail with respect to FIG. 3.

Figure 3:
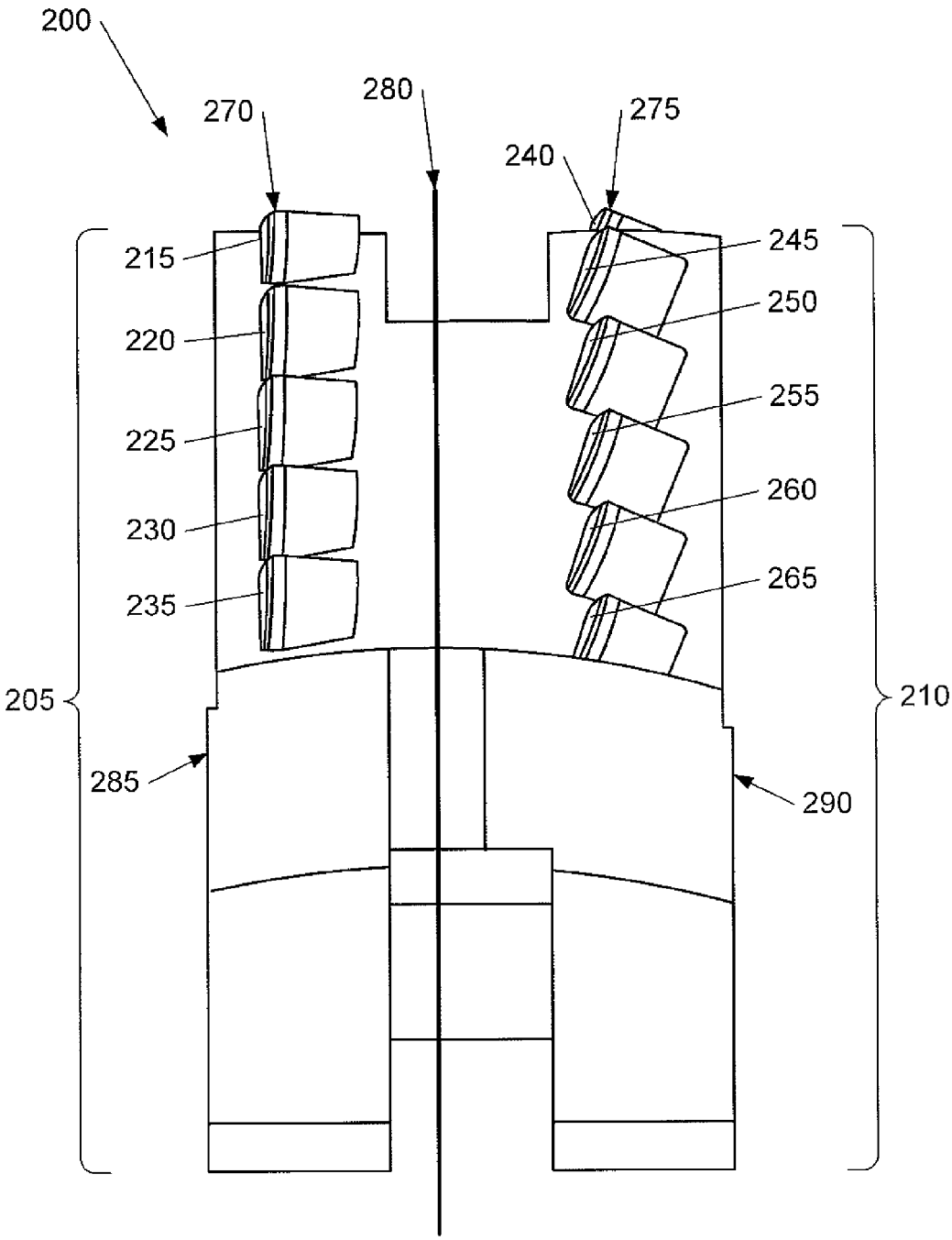
FIG. 3 illustrates cutters mounted on an arm of the reamer tool shown in FIGS. 1 and 2.

In FIG. 3, a portion 200 of a cutter arm 110 of the reamer tool 100 shown in FIGS. 1 and 2 is shown in more detail. The positioning of the cutting elements with respect to the cutter arm 110 is shown. The portion 200 shows a single cutter arm 110 (FIG. 1) having two cutting blades 205, 210, a front cutting blade 205 and a back cutting blade 210. [The terms "front" and "back" refer to the order in which the cutting blades make contact with the walls of a wellbore formed in a formation and is determined by the direction of rotation of the drill string (not shown) of which the reamer tool 100 (FIG. 1) forms a part.]

In the embodiment shown in FIG. 3, five cutting elements 215, 220, 225, 230, 235 are visible on front cutting blade 205, and six cutting elements 240, 245, 250, 255, 260, 265 are visible on back cutting blade 210. Cutting element 215 on front cutting blade 205 and cutting element 240 on back cutting blade 210 have respective attack points 270, 275 which are equi-spaced from a plane 280 that is coincident with the longitudinal axis 180 of the reamer body 105 (FIG. 1). This means that the distance from side 285 of front cutting blade 205 to the plane 280 is shorter than the distance from side 290 of back cutting blade 210 to plane 280.

In the embodiment shown in FIG. 3, the cutting elements 215, 220, 225, 230, 235, 240, 245, 250, 255, 260, 265 comprise PDC elements as shown. Although eleven PDC elements are visible, the number of PDC elements present on each blade 205, 210 is determined in accordance with the dimensions of the PDC element and the dimension of the reamer tool itself. However, it will be appreciated that other types of cutting elements may also be used, for example, impregnated cutting elements.

By having the attack points 270, 275 equi-spaced from the plane 280, attack points 270, 275 will contact the formation for any opening size in the opening range. If the attack points 270, 275 are not equi-distant from the plane 280, the cutter arms will only have one possible opening size to ensure that both the front and back cutting blades make contact with the formation.

The front and back blades 205, 210 as described above have different numbers of cutting elements 215, 220, 225, 230, 235, 240, 245, 250, 255, 260, 265 which are not aligned with one another so that the attack points 270, 275 of cutting elements 215, 240 are at different heights with respect to the reamer body 105.

The effective outer diameter of the reamer tool 100, that is, the opening size is determined by the positions of attack points 270, 275.

Figure 4:
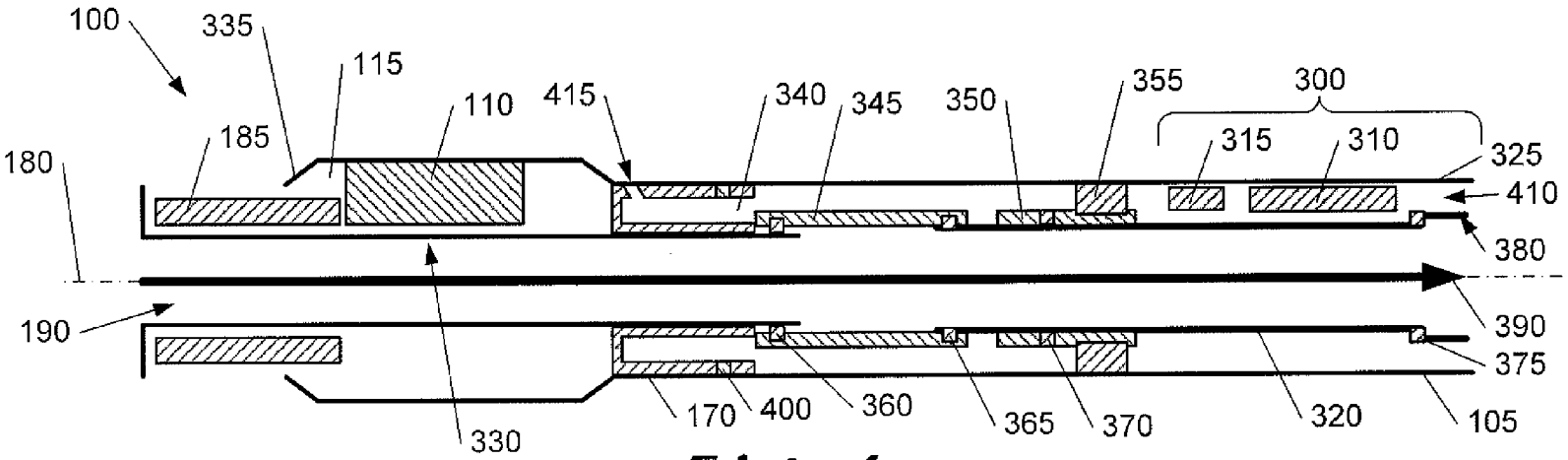
FIG. 4 illustrates a sectioned view of a control system for the reamer tool shown FIGS. 1 and 2 with the reamer tool in the stowed position.
Figure 5:
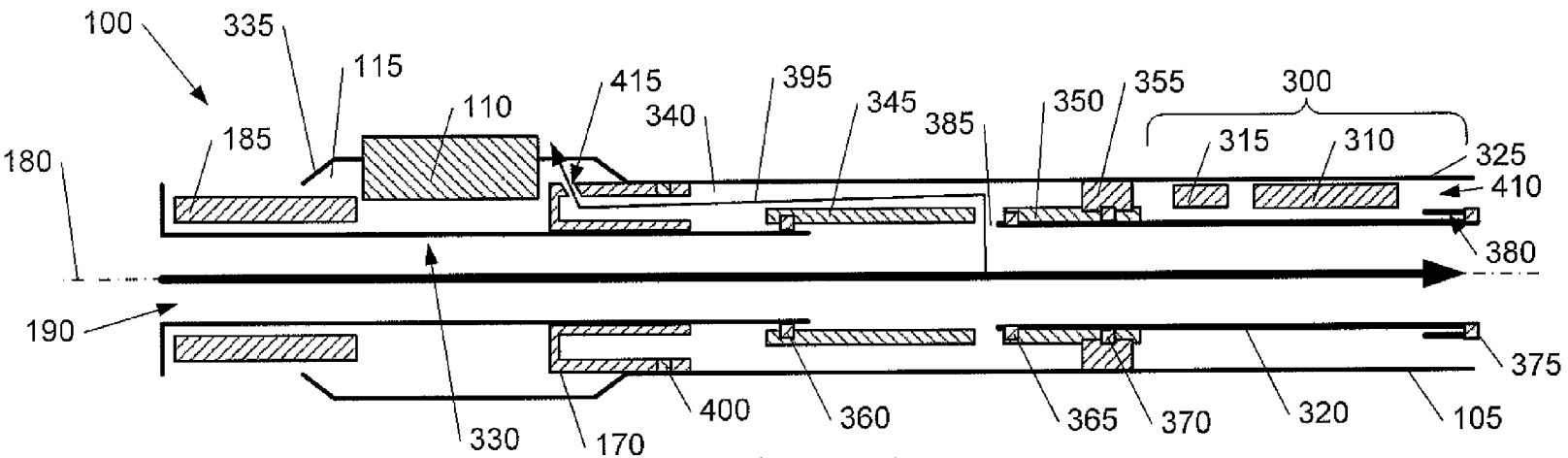
FIG. 5 is similar to FIG. 4 but illustrates the control system with the reamer tool in the expanded position.

Referring now to FIGS. 4 and 5, a schematic longitudinal sectioned view of the reamer tool 100 is shown. Components that have previously been described with reference to FIGS. 1 and 2 have the same reference numerals.

The reamer tool 100 comprises the reamer body 105 having cutter arms 110 mounted within respective housings or arm bays 115 formed in the reamer body 105 as described above. The links and the pivot points that operate the cutter arms 110 as described above are not shown for clarity. The spring 185 that is used to return the expanded cutter arms to their retracted position is shown schematically as a block.

As described above, the force for expanding the cutter arms 110 is provided by pressure applied to the piston 170 due to fluid flow through the reamer tool 100, and, the force for retracting the cutter arms is provided by the spring 185. During expansion of the cutter arms, the pressure exerted on the piston 170 creates a force which is greater than the force provided by the spring 185. Once the pressure exerted on the piston 170 falls sufficiently so that the force exerted becomes less than the force provided by the spring 185, the spring 185 causes the cutter arms 110 to be retracted into their respective housings or arm bays 115. This is described in more detail below.

A control system 300 for deploying the cutter arms 110 is provided within the reamer body 105 and comprises an electric motor 310, a gearing system 315 and a moveable sleeve 320, the electric motor 310 and gearing system 315 being housed between the sleeve 320 and an external wall 325 of the reamer body 105. The electric motor 310 rotates at a first predetermined speed and the gearing system 315 reduces that first predetermined speed to a second lower predetermined speed which is used for operating the moveable sleeve 320. In one embodiment, a ball screw (not shown) may be used to transfer the rotational output from the gearing system 315 to a linear movement which is used to move the sleeve 320 to open and close port 385 as will be described in more detail below. However, it will be appreciated that other arrangements may be used for transferring rotary motion from the gearing system 315 to linear motion of the moveable sleeve 320, for example, a pinion or worm gear forming part of the gearing system 315 may engage with a rack element provided on the moveable sleeve 320.

The electric motor 310 may be powered by a battery (not shown) or from a turbine provided in the drill string (also not shown), the turbine generating a current from the fluid flow therethrough. Although a gearing system 315 is described, it will be appreciated that drive from the motor may be converted into linear movement by any suitable means for converting the output of the motor into linear movement.

The housing or arm bay 115 for each cutter arm 110 is defined by a wall 330 of the hollow central portion 190 and a portion 335 of the external wall 325 of the reamer body 105. The piston 170 is defined by a chamber 340 adjacent the cutter arm 110, the chamber 340 being defined by the wall 330 of the central portion 190, external wall 325 of the reamer body 105, sleeve 320, first cylindrical portion 345, second cylindrical portion 350 and end wall 355 as shown. End wall 355 also forms barrier between the electric motor 310 and gearing system 315 of the control system 300.

Annular seals 360, 365 are provided between the first cylindrical portion 345 and respective ones of wall 330 and sleeve 320. Additional annular seals 370, 375 are provided between sleeve 320 and second cylindrical portion 350 and with wall 380 of hollow central portion 190. Seal 360 can be mounted on either the first cylindrical portion 345 or the wall 330 as the first cylindrical portion 345 does not move relative to the wall 330.

The first and second cylindrical portions 345, 350 define the port 385 which is sealed by the moveable sleeve 320 when in a first position, as shown in FIG. 4, so that fluid flows through the hollow central portion 190 as indicated by arrow 390. When the sleeve 320 is in a second position, as shown in FIG. 5, the port 385 is open and fluid can flow into chamber 340 as shown by arrow 395.

An additional seal 400 is also provided between the piston 170 and the external wall 325 of the reamer body 105 as shown to prevent ingress of drilling fluid as the piston 170 moves from the position shown in FIG. 4 to the position shown in FIG. 5.

Operation of the electric motor 310 effectively moves the sleeve 320 in the same direction as arrow 390 to open the port 385 and in the opposite direction to close the port 385, drive from the electric motor 310 being transmitted to the sleeve 320 via the gearing system 315. A control signal for the electric motor 310 is provided by way of an increased fluid flow rate through the hollow central portion 190 and/or speed of rotation of the drill string (not shown). At least one suitable sensor (not shown) is provided to sense the change in pressure and/or rotational speed and to provide a control signal for the electric motor 310, for example, a pressure sensor for sensing changes in pressure and an accelerometer for sensing the change in rotational speed. However, other sensors may also be used for sensing the change in rotational speed.

It will be appreciated that the electric motor 310 may be a bi-directional motor that operates in two directions to effect opening and closing of the port 385. As an alternative to the electric motor 310, a solenoid may be used to effect opening and closing of the port 385.

Naturally, the electric motor 310 and gearing system 315 are sealed within a region 410 defined by the sleeve 320 and an external wall 325 so that it is protected from the drilling environment, that is, the mud, rock etc., that finds its way into the hollow central region 190. In a preferred embodiment, the region 410 is filled with oil to prevent the ingress debris from the drilling environment.

Before the cutter arms 110 are expanded, they are housed in their respective housings or arm bays 115 as described above. Fluid flow is through the hollow central portion 190 as indicated by arrow 390 (FIG. 4). When a control signal is sent to the electric motor 310, by way of a change in pressure of the fluid flowing through the hollow central portion 190 and/or a change in the rotational speed of the drill string as described above, the electric motor 310 operates the moveable sleeve 320 to move it in the same direction as the fluid flow as indicated by arrow 390 to open port 385 (FIG. 5).

When the port 385 is opened, fluid flows into the chamber 340 and pressure builds up therein. When the pressure in the chamber 340 reaches a value where the force exerted by the piston 170 is greater than the force exerted by the spring 185, the piston 170 is pushed from the position shown in FIG. 4 towards the arm bays 115 to expand the cutter arms 110 as shown in FIG. 5. Movement of the piston 170 towards the arm bays 115 causes each cutter arm 110 to pivot about pivot point 150 on link 135, as well as pivot points 140, 145 on links 125, 130, so that it is expanded from the within its associated arm bay 115 as shown in FIGS. 1 and 4, to the position as shown in FIGS. 2 and 5. Fluid built up in the chamber 340 flows out of nozzles 415 associated with the cutter arms 110 maintaining the position of the piston 170 as shown in FIGS. 2 and 5, and hence the expansion of the cutter arms 110, until the port 385 is closed by the sleeve 320 by the operation of the motor 310 and gearing mechanism 315.

On receipt of a further control signal, that is, another change in pressure of the fluid flow and/or a change in rotational speed of the drill string, the motor 310 is activated once again to move the moveable sleeve 320 from the position shown in FIG. 5 back to the position shown in FIG. 4, thereby closing the port 385 so that no more fluid flows into the chamber 340 as indicated by arrow 395. Fluid flows out of nozzles 415 until the pressure in the chamber 340 is reduced so that the force of the spring 185 causes the cutter arms 110 to be returned to their associated housing or arm bay 115 to be returned to the position shown in FIGS. 1 and 4. In addition, the piston 170 is pushed back but the force exerted by the spring 185 to its initial position as shown in FIGS. 1 and 4.

Alternatively, instead of operating the motor 310, the cutter arms 110 may be retracted by turning the pump off that is associated with the drill string so that fluid flow is switched off through the drill string, and the pressure in the chamber 340 falls as no further fluid flows through the port 385 and into the chamber 340. Once the pressure in the chamber 340 falls to a value where the force exerted by the spring 185 exceeds that of provided by the pressure in the chamber 340, the piston 170 is moved back to the position shown in FIGS. 1 and 4 and the cutting arms 110 retracted whilst still parallel to the longitudinal axis 180 due to their pivoting about points 140, 145, 150; pivoting of the links 125, 130 about points 155, 160 in the respective housing or arm bay 115; and pivoting about pivot point 165 due to movement of the piston 170 as it moves from the position shown in FIG. 5 back to the position shown in FIG. 4.

As mentioned above, the control system 300 includes a power supply (not shown), but it may also include other electronic equipment, for example, pressure sensors for sensing the pressure in the chamber 340, accelerometers for measuring the speed of movement of the sleeve 320 and piston 170 and the rotational speed of the drill string, as well as the speed of the cutter arm 110 during its expansion and retraction phases. In addition, a communication device (not shown) may be provided through which control signals can be provided for the electric motor in the case where the control signals are not supplied by changes in pressure of the fluid flow or rotational speed of the drill string as described above.

The power supply may be provided by one or more batteries or via a wired link from the surface. Additionally, the wired link may form part of the communication device through which the control signals may be transmitted to the electric motor.

It will be appreciated that the cutter arm expansion mechanism can be used with other tools, for example, downhole stabilisers, and the cutter arms can be expanded using other expansion mechanisms.

Although a specific embodiment of the present invention is described, it will be appreciated that this embodiment is not limiting and other embodiments may fall within the scope of the invention as defined by the appended claims.

The invention claimed is:

1. A downhole tool comprising:

a substantially hollow body having a longitudinal axis and including an external wall having a first outer diameter;

at least one arm bay formed in a portion of the external wall around a periphery of the body;

at least one expandable arm located in an associated arm bay and mounted for expansion between a retracted position within the body and an expanded position in which each expandable arm describes a second outer diameter which is greater than the first outer diameter;

at least one expansion mechanism for expanding an associated expandable arm between the retracted and expanded positions, wherein each expansion mechanism comprises a first elongate link and a second elongate link, said first elongate link pivotally connected to its associated expandable arm at one end position and to its associated arm bay at another end position, said second elongate link pivotally connected to its associated expandable arm at one end position and to its associated arm bay at another end position, each expandable arm being pivotally mounted at its respective end positions with respect to its associated arm bay so that each expandable arm is maintained substantially parallel to the longitudinal axis in both the retracted and expanded positions, and, during its expansion and retraction between the retracted and expanded positions; and an actuation mechanism for activating the expansion mechanism, wherein the expansion mechanism further comprises a third elongate link pivotally connected, independently from the first elongate link and the second elongate link, to its associated expandable arm at one end position and to the actuation mechanism at another end position.

2. The downhole tool of claim 1, wherein the actuation mechanism comprises a piston.

3. A control module for a downhole tool, the downhole tool including a substantially hollow body having a longitudinal axis at least one arm bay formed around a periphery of the substantially hollow body at least one expandable arm located in an associated arm bay and mounted for expansion between a retracted position within the substantially hollow body and an expanded position in which the expandable arm describes a second outer diameter which is greater than a first outer diameter, at least one expansion mechanism for expanding an associated expandable arm between the retracted and expanded positions, and a piston for operating each expandable arm the control module comprising:

an element mounted within the body which is moveable between a first position and second position;

a motor controlling a movement of the element;

a gearing mechanism associated with the motor for transferring drive from the motor to the element; and a chamber and a port the chamber being associated with the piston and the port having an open position and a closed position, the open and closed position being determined by the second and first positions respectively of the element, and in that the port in its open position, allows fluid to flow into the chamber and to increase a pressure therein for operation of the piston to expand each expandable arm.

4. The control module of claim 3, wherein the motor and gearing mechanism are mounted between the element and an external wall of the body.

5. The control module of claim 3, further comprising a power source located within the body.

6. The control module of claim 5, wherein the power source comprises a battery.

7. The control module of claim 5, wherein the power source comprises a turbine arranged to generate power for the motor.

8. The control module of claim 3, further comprising at least one positional sensor for sending the position of the element within the body.

9. The control module of claim 3, further comprising at least one pressure sensor for sending the pressure within the chamber.

10. The control module of claim 3, further comprising at least one sensor for sending at least a change in pressure in fluid flowing through the downhole tool, each sensor providing a control signal for the motor.

11. The control module of claim 3, further comprising at least one sensor for sensing a change in rotational speed of the downhole tool, each sensor providing a control signal for the motor.

12. The control module of claim 3, further comprising a communications system through which control signals are provided for the motor.

13. The control module of claim 12, wherein the communications system includes a wired link over which control signals are transmitted.

* * * * *